United States Patent [19]

Fleissner

[11] Patent Number: 5,020,241

[45] Date of Patent: Jun. 4, 1991

[54] SIEVE DRUM DEVICE WITH SCREEN COVER

[75] Inventor: Gerold Fleissner, Chur, Switzerland

[73] Assignee: Fleissner Maschinenfabrik AG, Rebstein, Switzerland

[21] Appl. No.: 481,640

[22] Filed: Feb. 20, 1990

[30] Foreign Application Priority Data

Feb. 18, 1989 [DE] Fed. Rep. of Germany ..... 3005001

[51] Int. Cl.[5] ..... F26B 11/02

[52] U.S. Cl. ..... 34/115; 34/122

[58] Field of Search ..... 34/115, 122, 114, 155, 34/158, 123, 108, 110

[56] References Cited

U.S. PATENT DOCUMENTS

| | | | |
|---|---|---|---|
| 3,411,220 | 11/1968 | Fleissner | 34/115 |
| 3,430,352 | 3/1969 | Fleissner | 34/115 |
| 3,460,266 | 8/1969 | Fleissner | 34/115 |
| 3,672,010 | 6/1972 | Fleissner | 34/115 |
| 4,137,646 | 2/1979 | Fuhring | 34/115 |
| 4,677,761 | 7/1987 | Rattner | 34/115 |

*Primary Examiner*—Henry A. Bennett
*Assistant Examiner*—Denise L. F. Gromada
*Attorney, Agent, or Firm*—Antonelli, Terry, Stout & Kraus

[57] ABSTRACT

In the sieve drum device, a screen cover is not arranged, as customary, horizontally with sieve drums located, for example, in side-by-side relationship, but rather concentrically surrounds the respective sieve drum in the region covered by the material. In order to facilitate cleaning of the screen cover, the cover is swingable swung about a joint arranged on an axis in parallel to the sieve drum axis.

6 Claims, 1 Drawing Sheet

SIEVE DRUM DEVICE WITH SCREEN COVER

BACKGROUND OF THE INVENTION

This invention relates to a sieve drum device for the flow-through heat treatment of a gas-permeable length of material, especially textile material, said device having a substantially closed housing, the inner space of which is subdivided by a wall into a treatment chamber and a fan chamber; at least one sieve drum which is under a suction draft which is covered in the peripheral zone not blanketed by the material and which is rotatably mounted in the treatment chamber as a conveying element; and a fan in the fan chamber at the end face side associated with this sieve drum, this fan blowing a treatment gas suctioned out of the sieve drum, after heating by means of an associated heating unit, again back into the treatment chamber via a perforated screen cover concentrically surrounding the sieve drum. The device including means for effecting movement of the perforated screen cover.

A similar device is known from DOS 3,006,758. A screen cover concentrically surrounding the sieve drum has the advantage that the air flowing to the sieve drum is not only dammed up by the screen cover, but it is also caused to blow more uniformly over the periphery onto the sieve drum. However, this construction has the disadvantage that, if any material to be treated should jam up on the sieve drum, a knot could be formed perhaps in the narrowed space between the screen cover and the sieve drum and then untangling of this know would hardly be possible. Also, cleaning of the screen cover is feasible only under conditions that are made difficult because the screen cover surrounds the sieve drum closely all around and thus cleaning utensils cannot reach the underside of the screen cover.

SUMMARY OF THE INVENTION

Starting with the device of the type heretofore described, the invention is based on the object of providing a sieve drum device wherein the advantages of the concentric arrangement of the of the screen cover are preserved, but the disadvantages thereof are avoided.

In order to attain this object, the invention provides that the screen cover is articulated in the treatment chamber to be swingable around on axis in parallel to the sieve drum axis. Thus, with the screen cover being swingable away from the sieve drum, the underside of the screen cover can likewise be readily reached, for example, during cleaning of the screen cover for lint removal; or, in the case of a jam of the length of material, such as knot, easily detached or separated from a position close to the sieve drum. It is expedient to effect the movement of the screen cover from a point outside of the housing; for this purpose, the screen cover should be suspended on a chain or the like which passes over a wheel that can be moved from the outside.

An especially advantageous structure is possible in a sieve drum device wherein several sieve drums are arranged in series (with the axes of the drums being parallel to each other) and the screen cove of the first sieve drum is swingably supported in the material feeding zone while the screen cover of the second sieve drum is swingably supported in the material discharge zone. In such a case, the mutually facing ends of the two screen covers are firmly connected with each other by way of a chain or the like, and this chain is guided around a wheel located at a spacing from the screen covers in the treatment chamber. Upon then turning the wheel, around which the chain or the like is passed, from the outside, both screen covers thus move simultaneously either toward the outside, i.e., away from the associated sieve drum, or, upon a rotation in the opposite direction, over again into an operative position concentric to each, respective, sieve drum.

BRIEF DESCRIPTION OF THE DRAWINGS

One embodiment of the device according to this invention is illustrated in the accompanying drawings wherein.

DETAILED DESCRIPTION OF THE INVENTION

Figure 1:
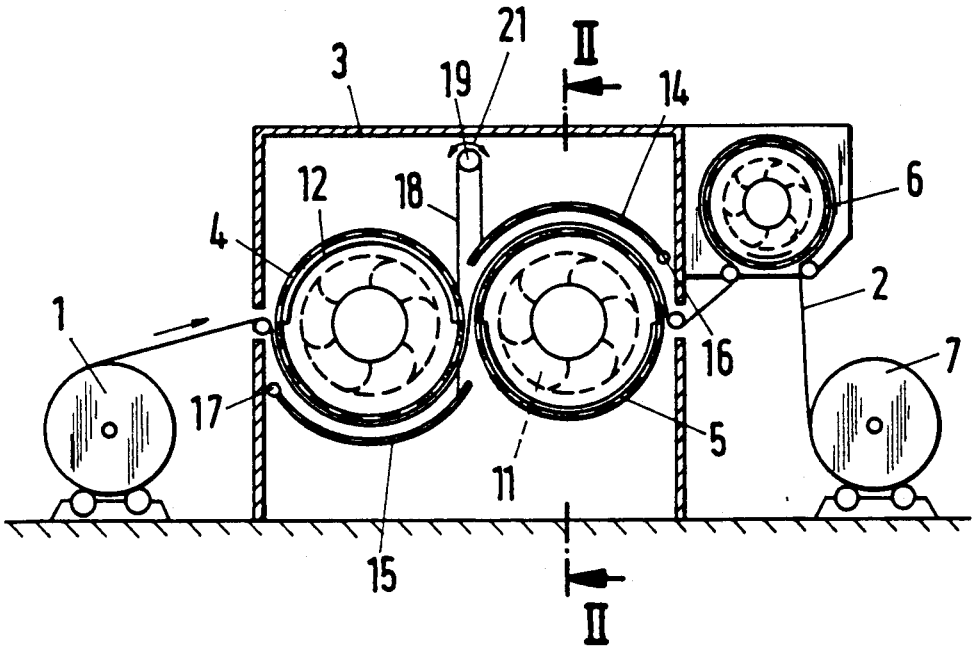
FIG. 1 shows a cross section through a sieve drum device in the conveying direction of the material.

The structure of a sieve drum device is generally well-known. A length of textile material 2, here drawn off a reel 1 is conducted into the sieve drum device, the sieve drums of which are surrounded by a housing 3. Within this housing, two sieve drums 4, 5 are arranged horizontally in series and are looped around by the textile material 2 in a meandering manner. After the heat treatment on the two sieve drums 4, 5, the textile material 2 travels over a cooling drum 6 again to reel 7.

Figure 2:
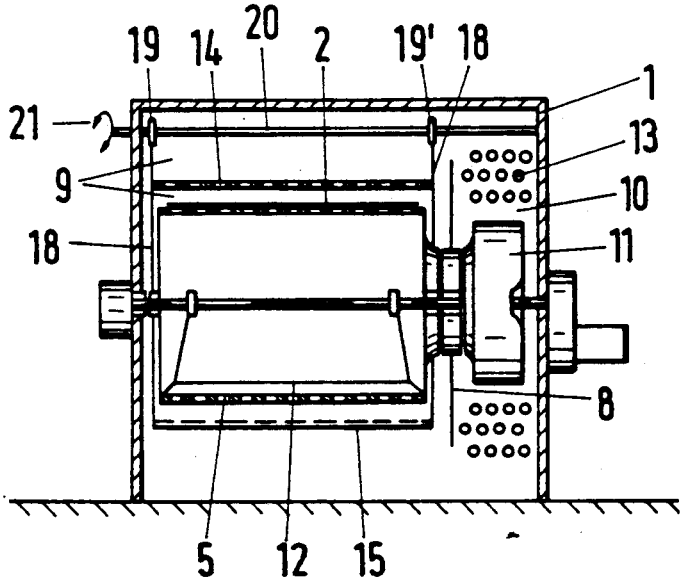
FIG. 2 shows a section taken along line II—II in FIG. 1.

According to FIG. 2, the housing 1 of the sieve drum device is subdivided by the wall 8 into a treatment chamber 9 and a fan chamber 10. At the end faces of the sieve drums 4, 5 and centrally to the drums, respectively, the fan 11 is arranged in the fan chamber; this fan suctions off the treatment air from the interior of the sieve drum and blows the air back again into the treatment chamber 9 in correspondence with the arrows. On the way from the fan to the treatment chamber, the air is heated up by means of the heating unit 13. Each respective sieve drum unit has a interior cover 12 in the region of the sieve drums 4, 5 not covered by the material 2.

The screen cover 14, arranged in the treatment chamber for rendering the flow of treatment air uniform over the operating width of the sieve drum, is provided, according to FIG. 1, in each case, concentrically about one of the two sieve drums 4, 5. Due to this uniform spacing between the screen cover 14 and the respective sieve drum 4, 5, a more uniform distribution of the treatment air over the operating width and also over the circumference of the sieve drum is ensured. In order to be able to remove the screen covers from these operative positions, the two screen covers 14, 15 are supported to be swingable about, respectively, a single joint or hinged means 16, 17. In this arrangement, the joint 17 at the first sieve drum 4 is provided in the material feeding zone and, at the second sieve drum 5, the joint 16 is provided in the material discharge zone of the sieve drum device. Accordingly, the mutually facing ends of the two screen covers 14 15 are in each case pivotable, i.e., swingable, in the upward or downward direction. As can be seen from FIG. 1, the free ends of the screen covers are firmly connected to chain 18, the chain being passed over a gear wheel 19 above the two sieve drums 4, 5. If now, the gear wheel 19 according to FIG. 1, rotates toward the left, then both screen covers 14, 15 are swung away from the associated sieve drum. In case of opposite rotation, the screen covers can readily be brought back into their operating positions without the need for the operator to reach into the treatment device. In order to bring this about, the axle 20 on which the gear wheel 19 is arranged extends outside the housing. Also, gear wheels 19 and 19' according to FIG. 2 are arranged on an axle 20, passing toward the outside through the housing 1 and consequently being easily turnable in correspondence with arrow 21 from that location so that chains 18 on each of the gear wheels 19, 19' cause rotation of covers 14 and 15.

What is claimed is:

1. A sieve drum device for the flow-through heat treatment of a gas-permeable length of material, which comprises a substantially closed housing, the inner space of which is subdivided by a wall into a treatment chamber and a fan chamber; a sieve drum, under a suction draft and covered in a peripheral zone not blanketed by the material, rotatably mounted in the treatment chamber as a conveying element; and a fan in the fan chamber associated with the sieve drum at an end face side of the sieve drum, said fan blowing a treatment gas suctioned out of the sieve drum, after heating by means of an associated heating unit, again back into the treatment chamber via a perforated screen cover concentrically surrounding the sieve drum, the screen cover being articulated in the treatment chamber to be swingable about an axis in parallel to the sieve drum axis.

2. A sieve drum device according to claim 1, wherein the screen cover is supported to be swingable away from the sieve drum out of its concentric arrangement.

3. A sieve drum device according to claim 2, wherein an end of the screen cover opposed to the axis of articulation is attached to a chain drivable by way of a drive mechanism arranged in the treatment chamber.

4. A sieve drum device according to claim 3, wherein the drive mechanism comprises a rotatably supported wheel drivable from outside of the housing.

5. A sieve drum device according to claim 1, wherein two series-arranged sieve drums are arranged in said treatment chamber and are looped around by a length of material in a meandering arrangement, each of the two sieve drums being concentrically surrounded by a perforated screen cover, a screen cover of a first sieve drum of the two series-arranged sieve drums being swingably mounted in a material feeding zone and a screen cover of a second sieve drum of the two series-arranged sieve drums being swingably mounted in a material discharge zone, and each of mutually facing ends of the two screen covers being firmly joined by way of a chain, wherein said chain is guided about a wheel located at a spacing from the screen covers in the treatment chamber.

6. A sieve drum device for the flow-through heat treatment of a gas-permeable length of textile material, which comprises a substantially closed housing, the inner space of which is subdivided by a wall into a treatment chamber and a fan chamber; a plurality of sieve drum, under a suction draft and covered in a peripheral zone not blanketed by the material, each rotatably mounted in the treatment chamber as a conveying element; and a plurality of fans in the fan chamber each fan being associated with one of the plurality of sieve drums, each fan blowing a treatment gas suctioned out of its associated sieve drum, after heating by means of an associated heating unit, again back into the treatment chamber via a perforated screen cover concentrically surrounding the associated sieve drum, the screen cover being articulated in the treatment chamber to be swingable about an axis in parallel to the associated sieve drum axis.

* * * * *